US012478822B2

(12) United States Patent
Chen

(10) Patent No.: US 12,478,822 B2
(45) Date of Patent: Nov. 25, 2025

(54) ADJUSTMENT STRUCTURE OF FITNESS EQUIPMENT

(71) Applicant: Paul Chen, Taichung (TW)

(72) Inventor: Paul Chen, Taichung (TW)

(73) Assignee: FLORIEY INDUSTRIES INTERNATIONAL CO., LTD.

( * ) Notice: Subject to any disclaimer, the term of this patent is extended or adjusted under 35 U.S.C. 154(b) by 75 days.

(21) Appl. No.: 18/641,422

(22) Filed: Apr. 21, 2024

(65) Prior Publication Data

US 2025/0325865 A1 Oct. 23, 2025

(51) Int. Cl.
*A63B 21/075* (2006.01)
*A63B 21/072* (2006.01)

(52) U.S. Cl.
CPC ..... *A63B 21/075* (2013.01); *A63B 21/0728* (2013.01)

(58) Field of Classification Search
CPC ..... A63B 21/075; A63B 21/0728
See application file for complete search history.

(56) References Cited

U.S. PATENT DOCUMENTS

| | | | | |
|---|---|---|---|---|
| 11,191,993 | B1 * | 12/2021 | Chen | A63B 21/075 |
| 2010/0190618 | A1 * | 7/2010 | Chen | A63B 21/075 482/108 |
| 2010/0190619 | A1 * | 7/2010 | Chen | A63B 21/072 482/108 |
| 2021/0154519 | A1 * | 5/2021 | Chen | A63B 21/078 |

* cited by examiner

*Primary Examiner* — Andrew S Lo

(57) ABSTRACT

An adjustment structure of fitness equipment is provided. The adjustment structure of fitness equipment includes a holding component, having a mounting portion, and an assembly hole; an adjusting component, assembled on the mounting portion, and the adjusting component includes an adjusting plate, an adjusting protrusion and a spring; wherein the adjusting plate includes an assembly groove, the adjusting protrusion is movably embedded in the assembly groove, and two ends of the spring elastically against the bottom end of the adjusting protrusion and the bottom surface of the assembly groove respectively; and a movable fastener, including a shank and a head; wherein one end of the shank is connected to the head and the other end is used to movable insert into the assembly hole and the perforation; wherein the shank includes a plurality of serrated notch on outer surface, and the serrated notch corresponds to the incline portion.

10 Claims, 14 Drawing Sheets

ADJUSTMENT STRUCTURE OF FITNESS EQUIPMENT

FIELD OF THE DISCLOSURE

The present disclosure is related to an adjustment structure of fitness equipment, and more particularly to an adjustment structure in the fitness field.

BACKGROUND OF THE DISCLOSURE

Among the common fitness equipment, except for the kettlebell, whose weight is determined by the overall poundage and cannot be adjusted, other equipment can be adjusted by adding or reducing the weight plates according to the user's abilities and needs. However, most methods of removing or adding the weight plates to the equipment are through the screw threaded system, such as conventional arts TW M645012 and TW M624247. These types of methods are time-consuming, and some equipment requires numerous screws/bolts. In terms of overall operation, in addition to the time-consuming, the loss of screws is also a big problem. More importantly, the tightness of the screws/bolts is required to be considered. If the thread is not tight enough, problems such as the weight plate falling off may occur. Therefore, relevant industries are trying to provide a method or a device to solve the above problems and disadvantages.

SUMMARY OF THE DISCLOSURE

The present disclosure is related to an adjustment structure of fitness equipment, which provides users with a quick, convenient, and easy-to-use operation of adjusting the amount of weight plates. In the existing technology, the adjusting of the amount of the weight plates is carried out through screw locking. This method is too time-consuming and complicated to operate. Further, the tightness of the screws/bolts is required to be considered. If the thread is not tight enough, problems such as the weight plate falling off may occur.

In order to achieve the above-mentioned objectives and effects, an adjustment structure of fitness equipment is provided. The adjustment structure of fitness equipment includes a holding component, having a mounting portion, and an assembly hole through the mounting portion; an adjusting component, assembled on the mounting portion, and the adjusting component further includes an adjusting plate, an adjusting protrusion and a spring; wherein the adjusting plate includes an assembly groove, the adjusting protrusion is movably embedded in the assembly groove, and two ends of the spring elastically against the bottom end of the adjusting protrusion and the bottom surface of the assembly groove, respectively; wherein the spring elastically pushes the adjusting protrusion to move up and down in the assembly groove; wherein the adjusting protrusion has a perforation corresponds to the assembly hole, and the perforation has an incline portion on the hole wall surface; and a movable fastener, including a shank and a head; wherein one end of the shank is connected to the head and the other end is used to movable insert into the assembly hole and the perforation; wherein the shank includes a plurality of serrated notch on outer surface, and the serrated notch corresponds to the incline portion; wherein when the adjusting protrusion is elastically pushed by the spring, the incline portion is match and limited with the serrated notch.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
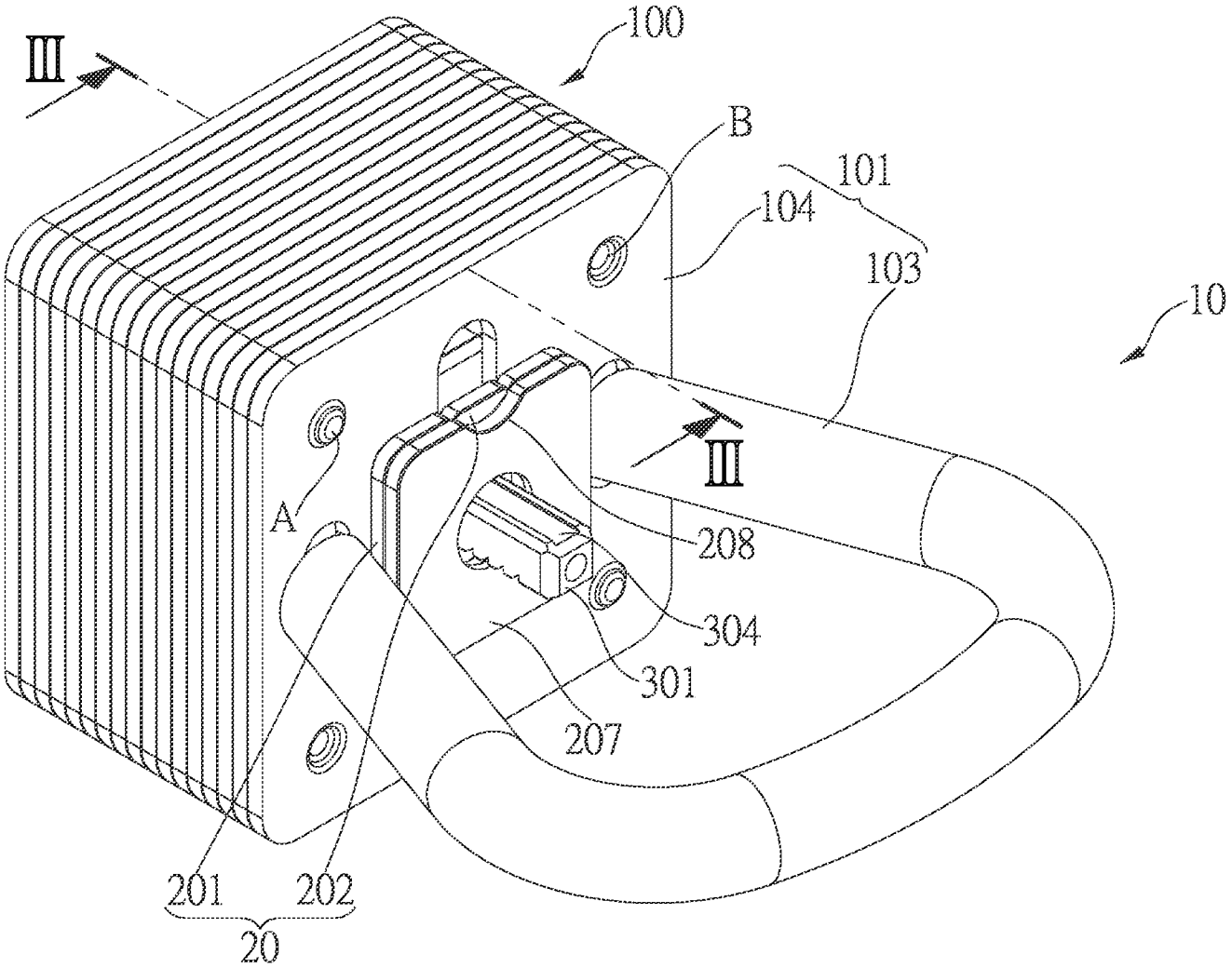
FIG. 1 is a perspective schematic view of the first embodiment of the present disclosure.

Referring to FIGS. 1-10, the present disclosure provides an adjustment structure of fitness equipment. The adjustment structure of fitness equipment includes a holding component 10, an adjusting component 20, and a movable fastener 30. The holding component 10 is mainly used to provide the operator's hand grip and force lifting. The holding component 10 has a mounting portion 101, and an assembly hole 102 through the mounting portion 101. The adjusting component 20 is assembled on the mounting portion 101, and the adjusting component 20 further includes an adjusting plate 201, an adjusting protrusion 202, and a spring 203.

Figure 2:
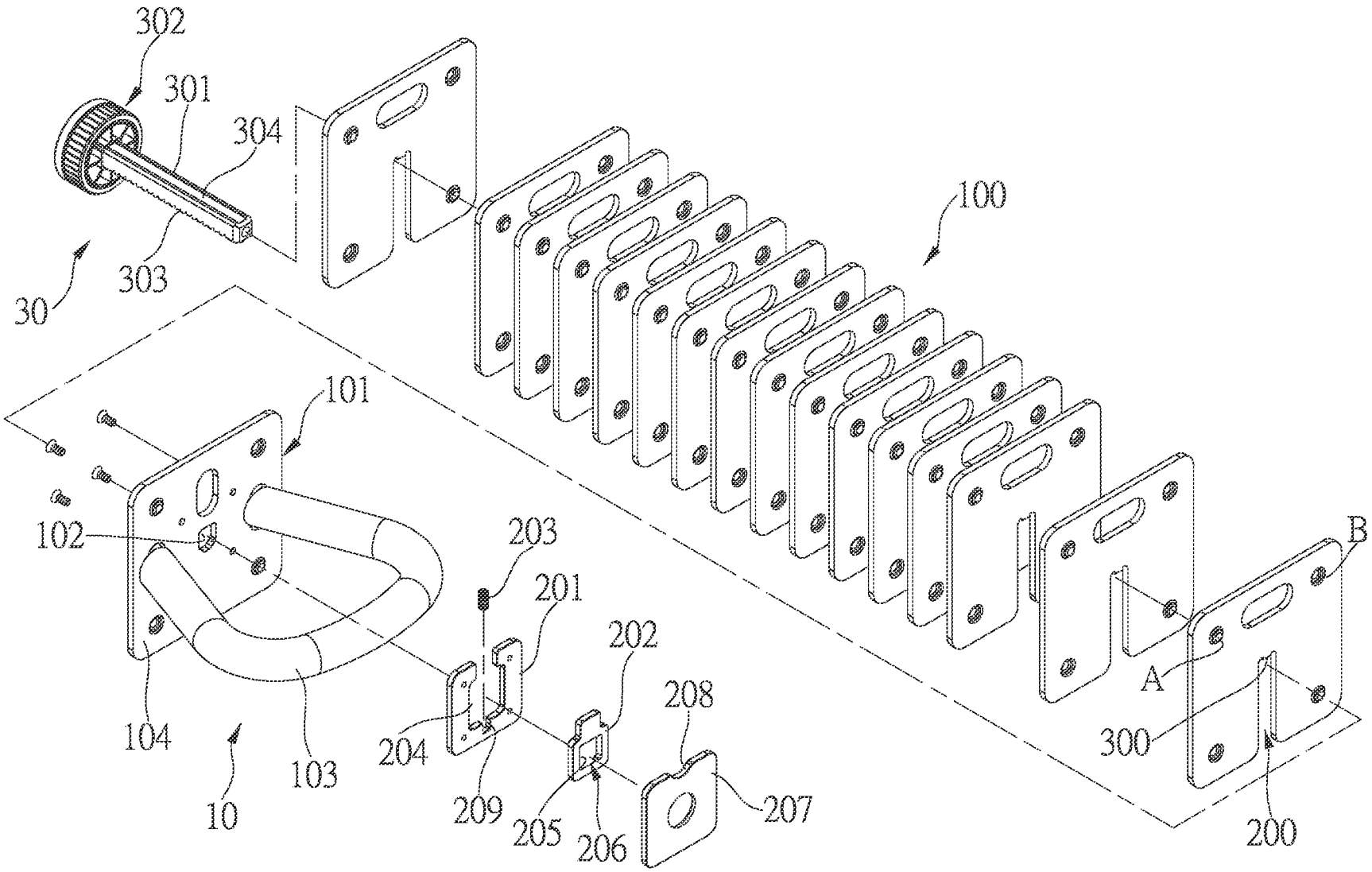
FIG. 2 is an exploded perspective schematic view of the first embodiment of the present disclosure.
Figure 2A:
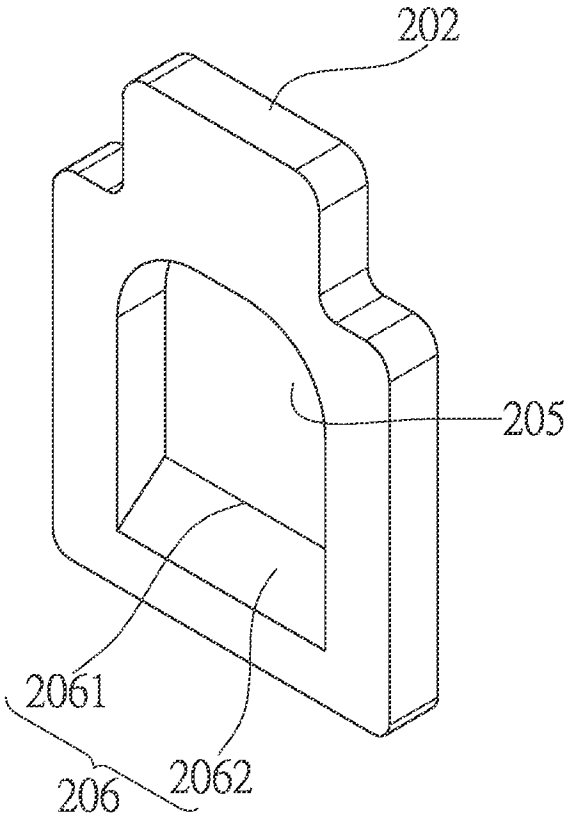
FIG. 2A is a schematic perspective view in another angel of the adjusting protrusion of the present disclosure.

Further, the adjusting plate 201 includes an assembly groove 204, the adjusting protrusion 202 is movably embedded in the assembly groove 204, and two ends of the spring elastically against the bottom end of the adjusting protrusion 202 and the bottom surface of the assembly groove 204, respectively. The spring 203 elastically pushes the adjusting protrusion 202 to move up and down in the assembly groove 204. The adjusting protrusion 202 has a perforation 205 corresponds to the assembly hole 102, and the perforation 205 has an incline portion 206 on the hole wall surface (as shown in FIG. 2A) The movable fastener 30 includes a shank 301 and a head 302. One end of the shank 301 is connected to the head 302 and the other end is used to movable insert into the assembly hole 102 and the perforation 205.

Figure 2B:
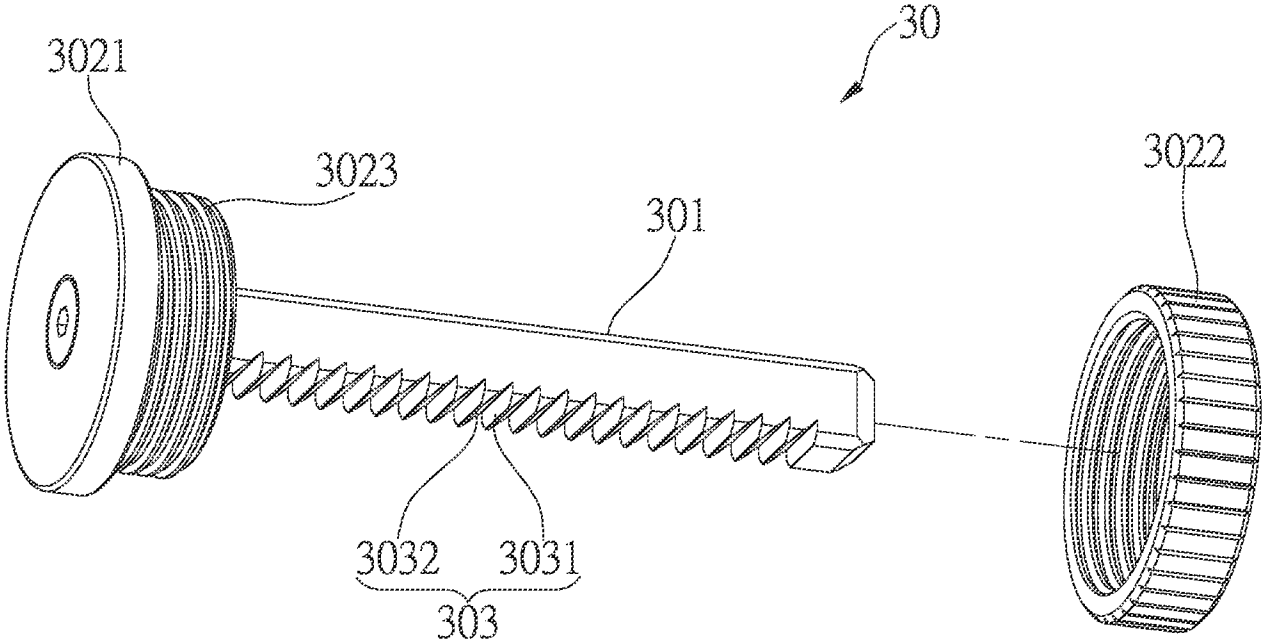
FIG. 2B is a schematic perspective view in another angel of the movable fastener of the present disclosure.
Figure 3:
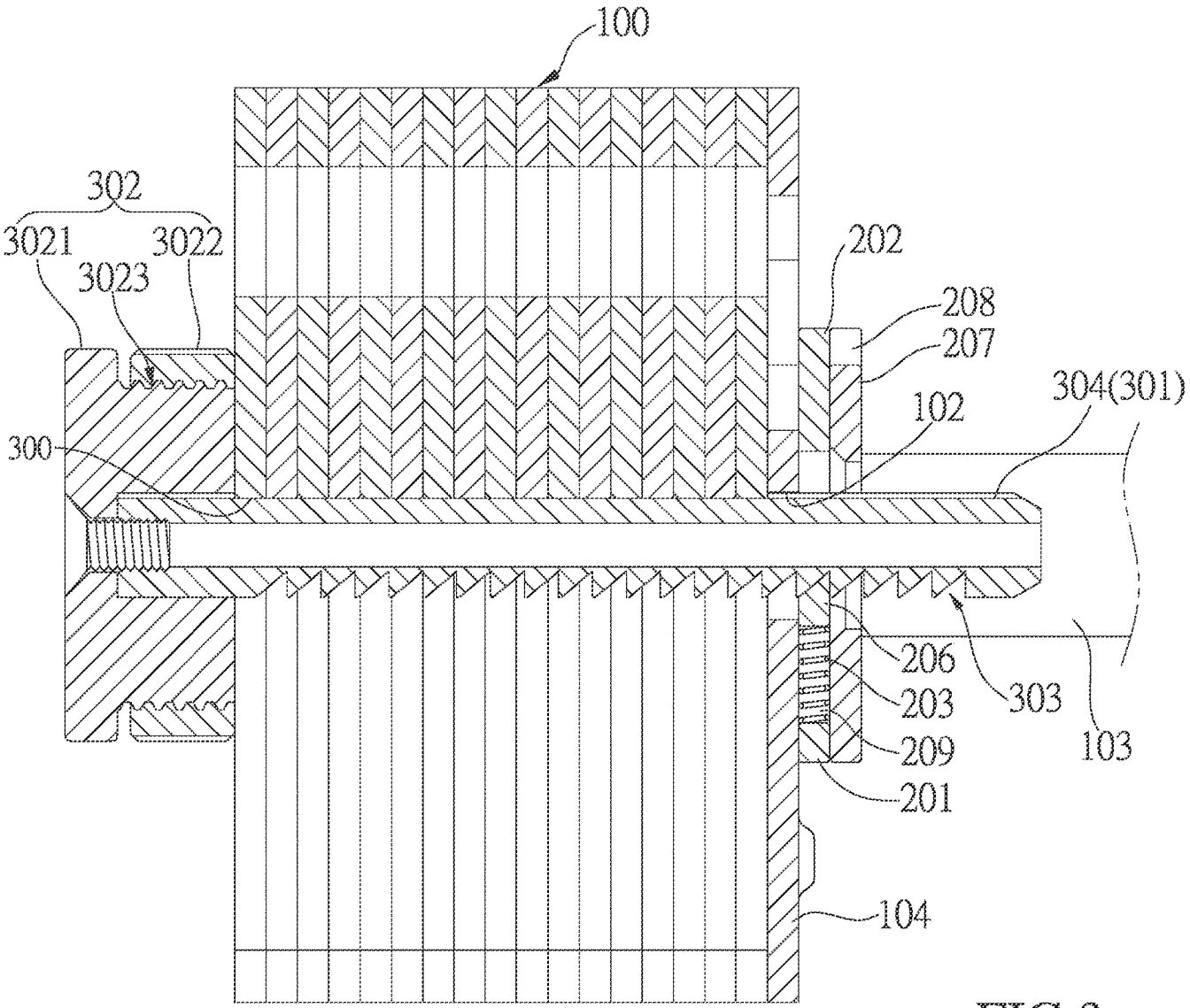
FIG. 3 is a sectional schematic view of line III-III of FIG. 1.

Further, the shank 301 includes a plurality of serrated notch 303 on the outer surface (as shown in FIG. 2B), and the serrated notch 303 corresponds to the incline portion 206. When the adjusting protrusion 202 is elastically pushed by the spring 203, the incline portion 206 matches and is limited by the serrated notch 303.

The adjusting protrusion 202 moves up and down in the assembly groove 204, so that the engagement between the incline portion 206 and the serrated notch 303 can be released. The movable fastener 30 can move relative to the holding component 10 in the axial direction, thereby adjusting the length of the movable fastener 30 to facilitate the installation and detachment of an appropriate number of weight plates 100.

According to the description above, the present disclosure allows users to adjust the amount of weight plates 100 quickly for appropriate weight when exercising with the fitness equipment. The user only needs to press the top of the adjusting protrusion 202 to move it downward and compress the spring 203 located below. At this time, the incline portion 206 located on the adjusting protrusion 202 will be disengaged from the serrated notch 303. Then, the user only needs to pull the movable fastener 30 to detach the weight plate 100. After adjusting to the required weight, the user can repeat the above operation to push the movable fastener 30 back.

Further, the head 302 and the holding component 10 are firmly clamped against the stack of the weight plates 100. This structural arrangement provides the user with a faster and more convenient way to adjust the weight of the equipment. Different from the conventional technology, which takes time to turn multiple screws to assemble and disassemble. Moreover, the screws are small parts and are easy to be lost. If the thread is not fastened, the weight plates can easily fall off. The present disclosure indeed improves the above problems and provides users with safer usage.

The present disclosure provides more embodiments. Firstly, to offer the user convenient control of the adjusting protrusion 202, on one side of the adjusting plate 201, the present disclosure further includes a baffle 207. The baffle 207 is attached to the adjusting plate 201 and blocks the assembly groove 204. The baffle 207 has an arc-shaped notch 208 recessed at the top, and a portion of the adjusting protrusion 202 protrudes from the arc-shaped notch 208. It is clear for the user to see where to press, and the baffle 207 is used to prevent the adjusting protrusion 202 from falling off.

Furthermore, the present disclosure illustrates a kettlebell type in a first embodiment as shown in FIGS. 1-6, a dumbbell type in a second embodiment as shown in FIGS. 7-10. Moreover, the actual usage type can also be applied to the barbell (not shown in the figures). The embodiments in the present disclosure are merely examples and are not meant to limit the scope of the present disclosure.

As shown in FIGS. 7-10, the holding component 10 further includes a holding bar 103 in a cylindrical shape. In detail, the holding bar 103 has two ends for engaging with the mounting portions 101 (the number of the mounting portions will be according to different types of fitness equipment), and the holding bar 103 passes through the assembly hole 102. The number of the adjusting component 20 is the same as the number of the mounting portion 101, and the movable handle 30 is the same as the number of the mounting portion 101.

Referring to FIG. 1 to FIG. 6, the holding component 10 further includes a holding bar 103 and a connecting piece 104, the holding bar 103 is in a U-shape and connected with the connecting piece 104 by two ends; wherein the assembly hole 102 is disposed on the connecting piece 104, and the adjusting plate 201 is disposed between the connecting piece 104 and the baffle 207, and the assembly groove 204 is covered.

Figure 4:
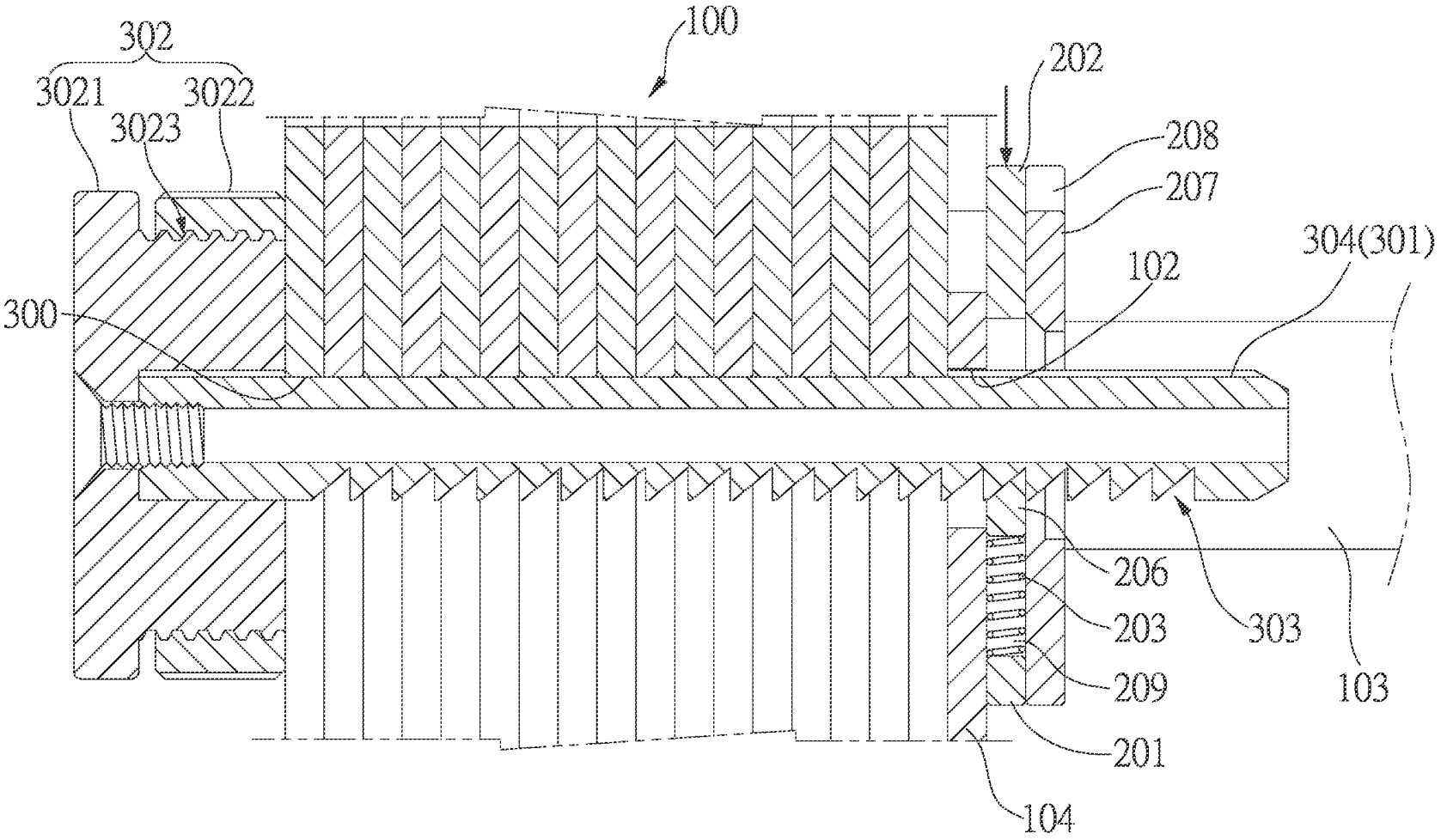
FIG. 4 is a partially enlarged schematic view of FIG. 3.
Figure 5:
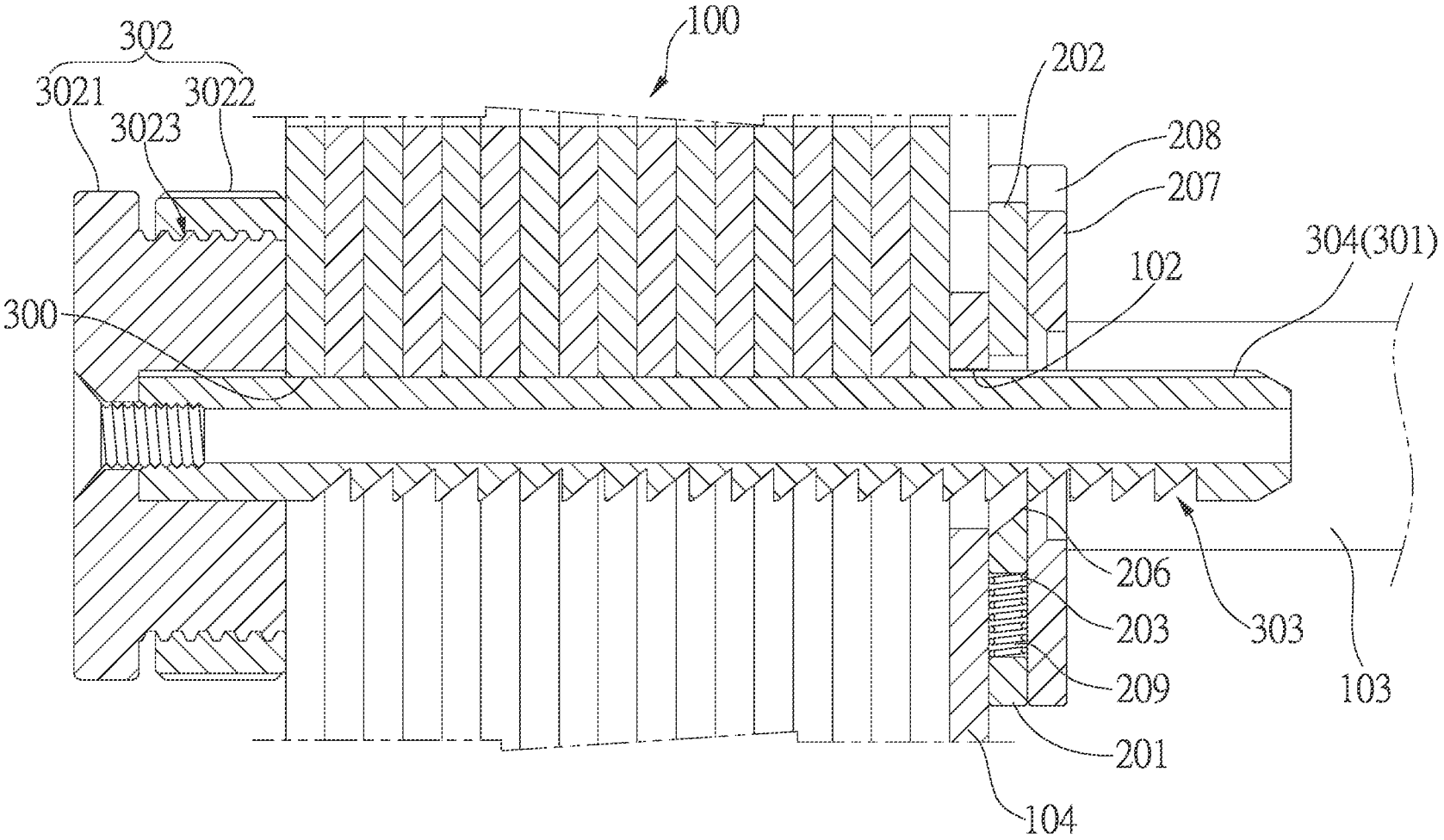
FIG. 5 is a schematic view of the movement in which the adjusting protrusion moves downward and presses against the spring, thus releasing the engagement between the incline portion and the serrated notch according to FIG. 4.
Figure 6:
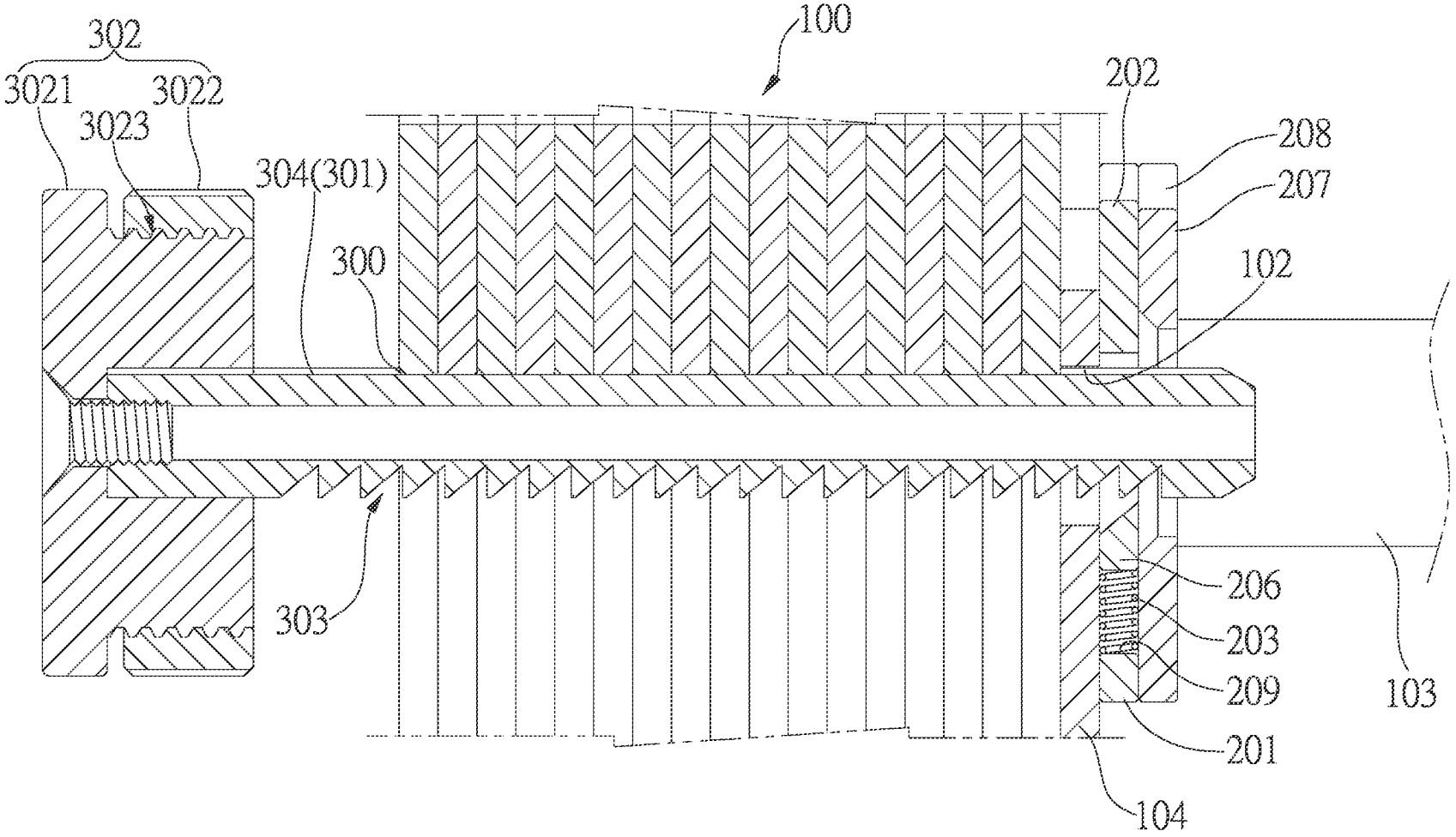
FIG. 6 is a schematic view of the movement of adjusting the movable fastener of FIG. 5.
Figure 7:
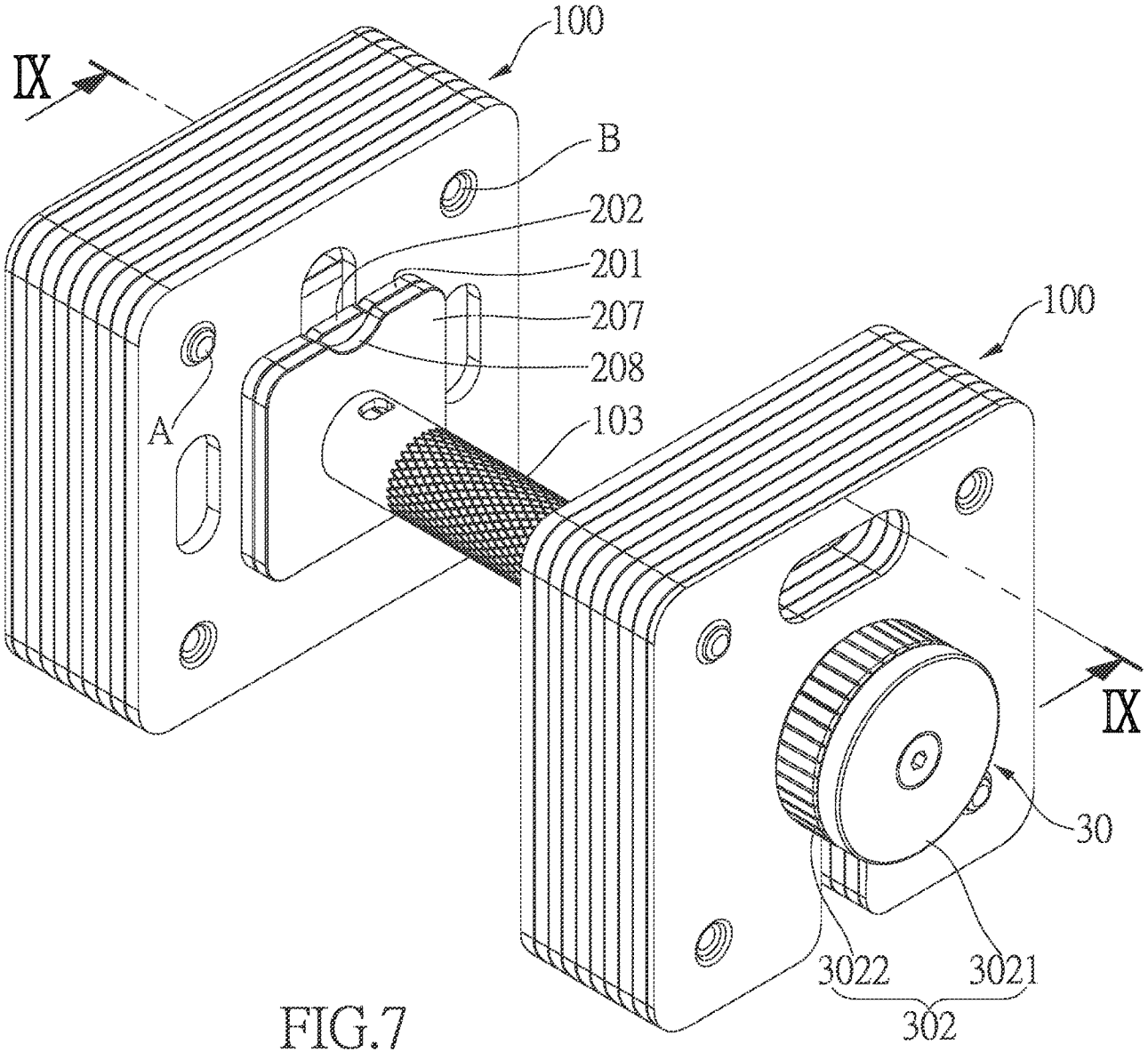
FIG. 7 is a perspective schematic view of the second embodiment of the present disclosure.
Figure 8:
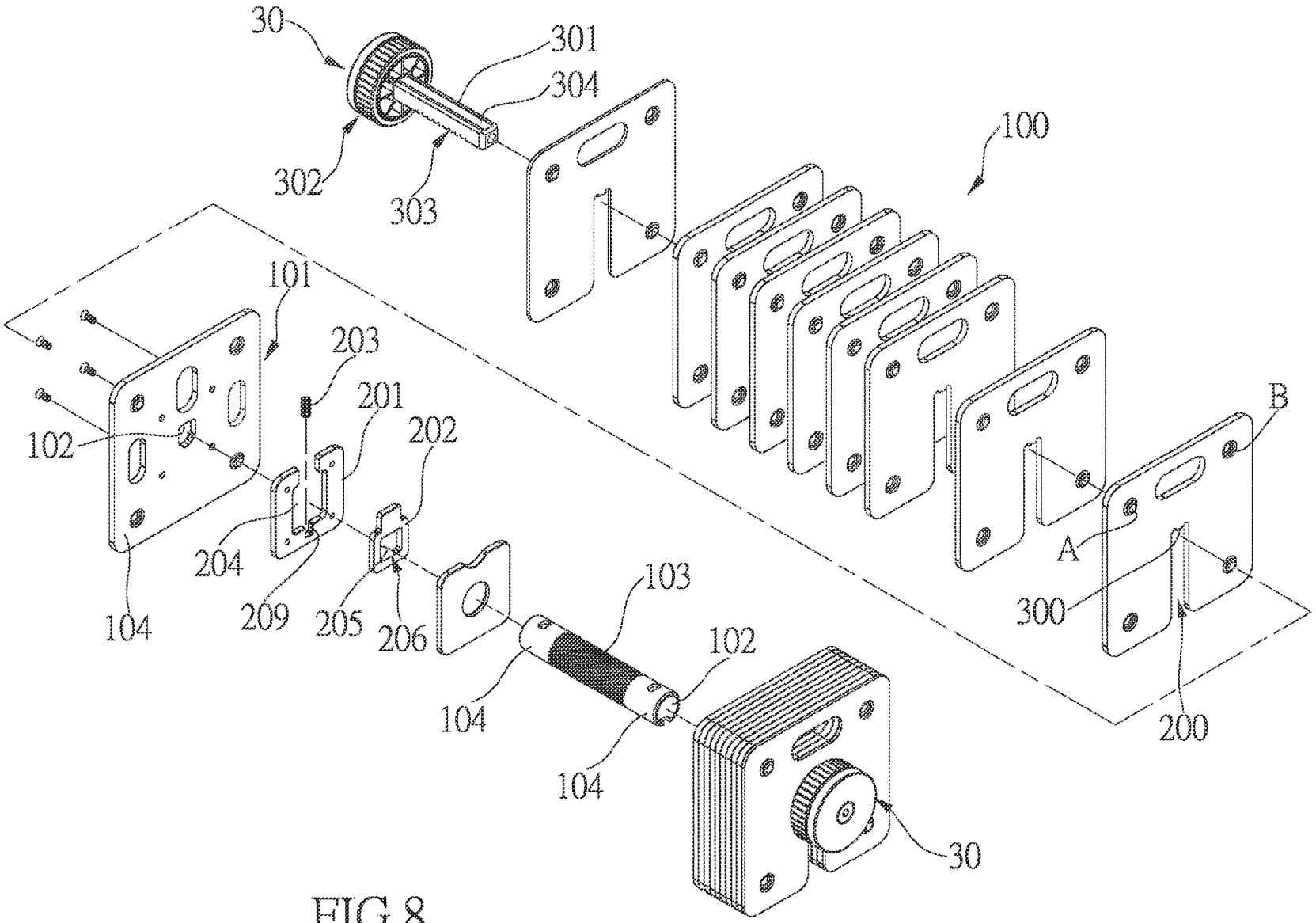
FIG. 8 is a perspective exploded schematic view of a second embodiment of the present disclosure.
Figure 9:
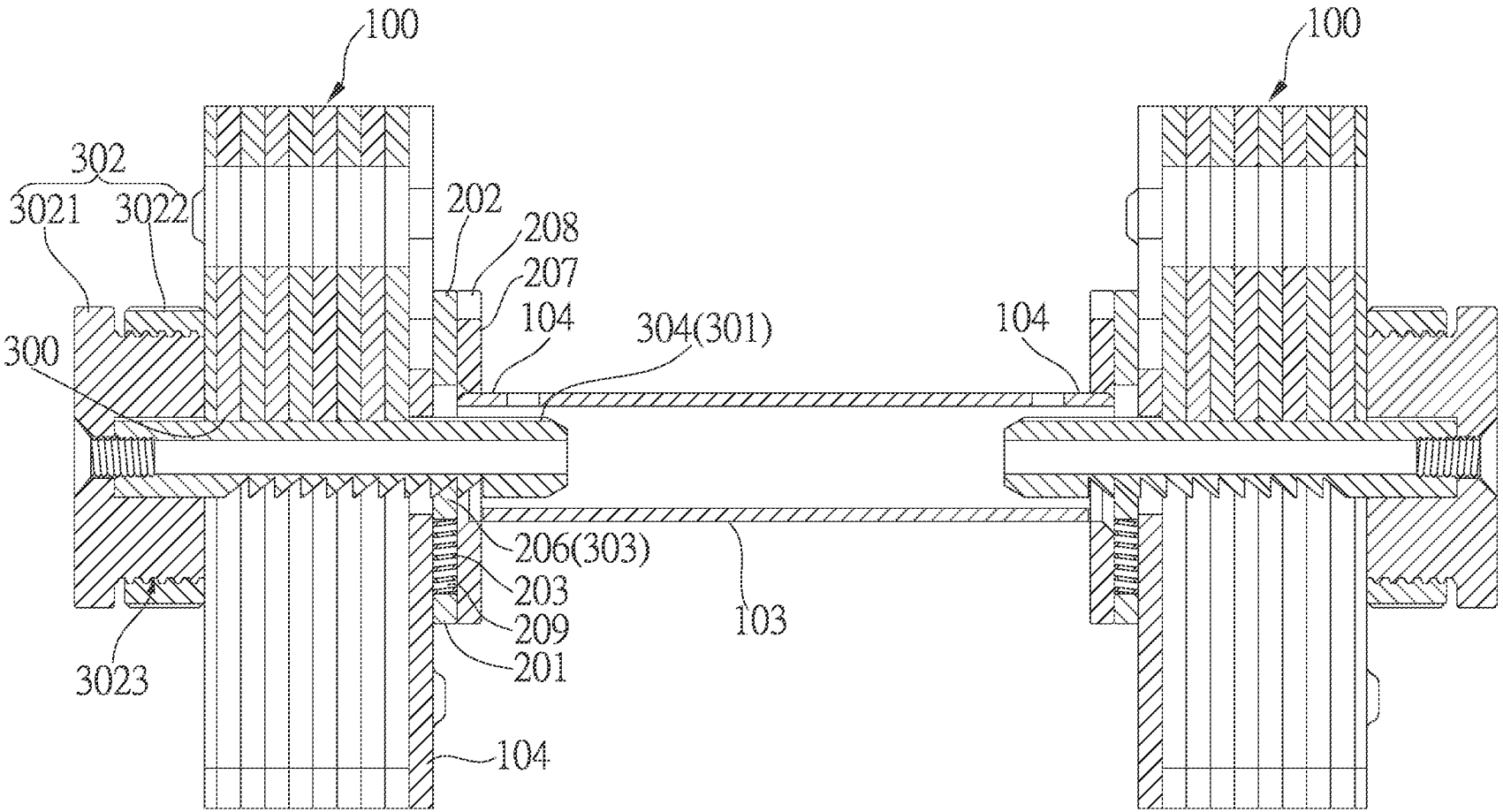
FIG. 9 is a sectional schematic view of line IX-IX of FIG. 7.
Figure 10:
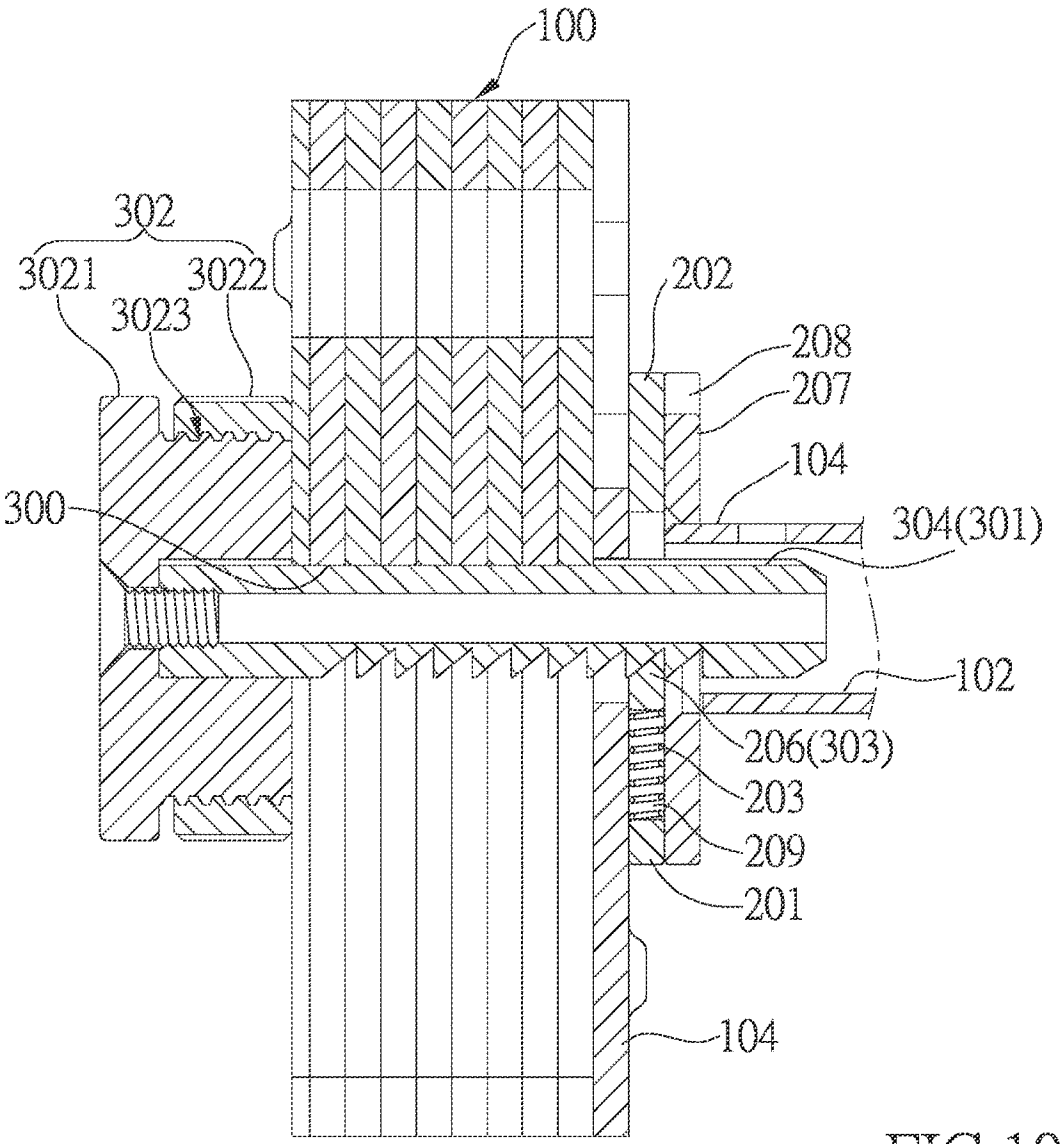
FIG. 10 is a partially enlarged schematic view of FIG. 9.

In addition, to prevent the spring 203 from falling off, the baffle 207 is used as a stopper, and the assembly groove 204 of the adjusting plate 201 further includes a spring notch 209 for accommodating the spring 203. Through the setting of the spring notch 209, the position of the spring 203 can be limited, and skewing of the spring 203 or displacement of the adjusting protrusion 202 can be avoided, as shown in FIGS. 2, 4, and 5.

In order to prevent each of the weight plates 100 from rotating during training, the shank 301 includes a limiting groove 304 on the outer surface opposite to the serrated notch 303. Further, each of the weight plates 100 has an engaging slot 200 recessed from one end toward the center, and a limiting fin 300 at the center of the engaging slot 200, so that the limiting fin 300 matches and engages with the limiting groove 304. In this way, in addition to being clamped, each of the weight plates 100 can be limited from being rotated by the engagement of the limiting fin 300 and the engaging slot 200. In addition, the movable fastener 30 is still available to be pulled and pushed while the weight plate 100 is being fixed without being affected, as shown in FIGS. 4, 6, 9 and 10.

Lastly, in order to stabilize the engagement between the incline portion 206 and the serrated notch 303, the serrated notch 303 of the shank 301 tapers from a notch open to a notch end. The serrated notch 303 includes a flat surface 3031 and an inclined surface 3032, and the incline portion 206 of the perforation 205 includes a flat tooth surface 2061 and an inclined tooth surface 2062. The incline portion 206 of the adjusting protrusion 202 inserts at the tip, and the flat tooth surface 2061 of the incline portion 206 abuts the flat surface 3031 of the serrated notch 303, and the inclined tooth surface 2062 of the incline portion 206 abuts the inclined surface 3032 of the serrated notch 303. The angle between the flat surface 3031 and the inclined surface 3032 of each serrated notch 303 is less than 90 degrees, by this feature the incline portion 206 can fitly match with the serrated notch 303, the flat tooth surface 2061 matches the flat surface 3031, and the inclined tooth surface 2062 matches the inclined surface 3032. The coupling force between the incline portion 206 and the serrated notch 303 is greatly strengthened, thereby the movable fastener 30 is stable and safe without sliding randomly.

In addition, to prevent the weight plate 100 from being unstable during operation, the present disclosure provides two methods to improve the stability between the weight plate 100 and the connecting piece 104. Firstly, each of the weight plate 100 and the connecting piece 104 includes a plurality of positioning convex parts A and a plurality of positioning concave parts B on opposite sides, so that the weight plate 100 is engaged with the connecting piece 104 or other weight plates 100 by matching the plurality of positioning convex parts A and the plurality of positioning concave parts B. Therefore, the stack between the weight plates 100, or the weight plate and the connecting piece 104, is mainly a method of matching and stacking convex and concave, so that the stack between the weight plates 100, or the weight plate 100 and the connecting piece 104 will be stable.

In addition to the above method, the structure at the head 302 is also an advantage in increasing the tightness between the weight plate 100 and the connecting piece 104, or between the plurality of weight plates 100. The head further includes a threaded head portion and a threaded nut portion, one end of the shank is connected to one side of the threaded head portion; wherein the threaded head portion has an outer thread on the outer periphery, and the threaded nut portion is threadedly engaged with the threaded head portion through the outer thread; wherein the threaded nut portion is screwed to press against the weight plate when the movable fastener moves the head to close to the weight plate, so that the weight plates fit closely to each other.

Figure 11:
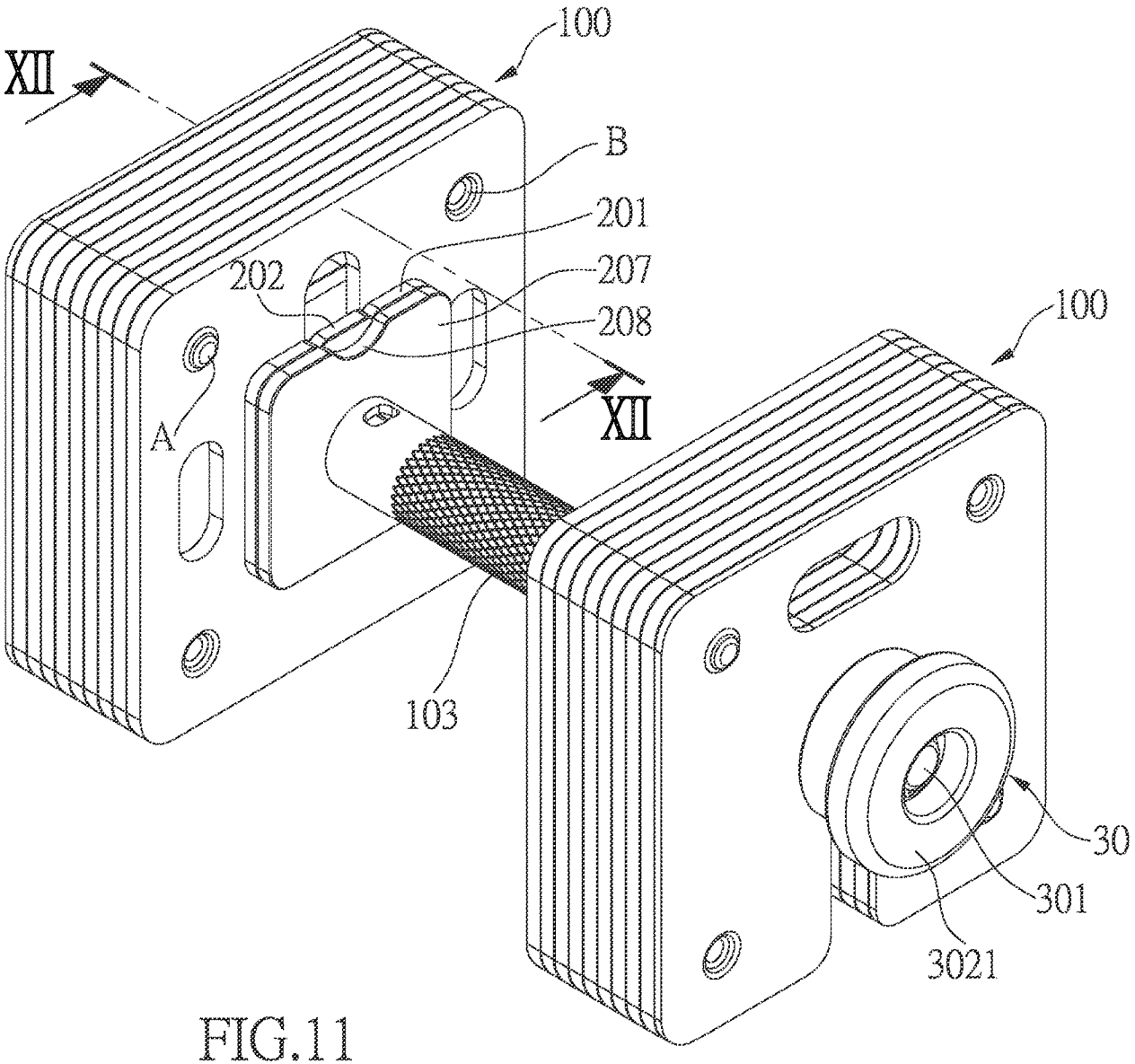
FIG. 11 is a perspective schematic view of the third embodiment of the present disclosure.
Figure 12:
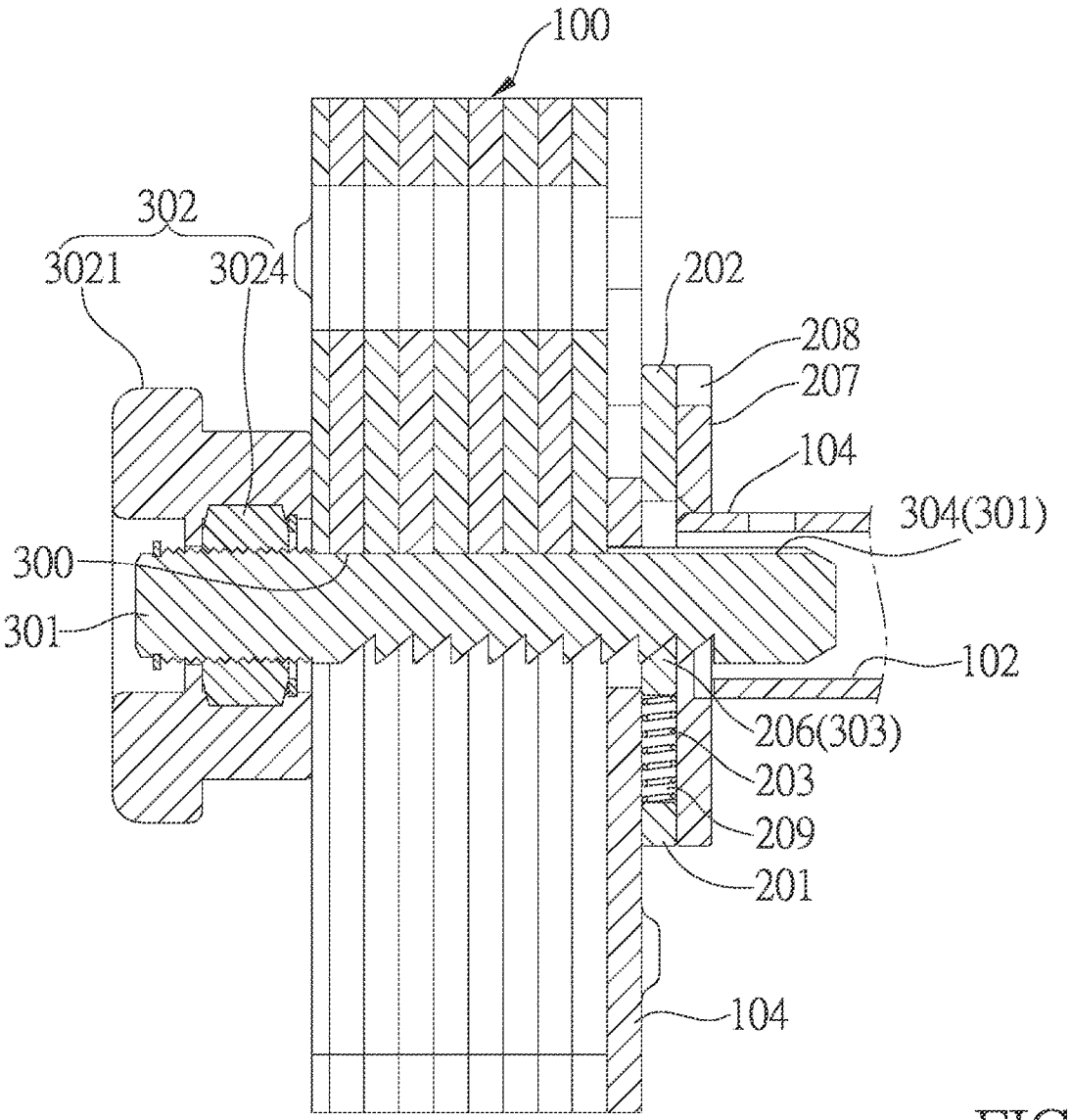
FIG. 12 is a sectional schematic view of lines XII-XII of FIG. 11.

Further, the present disclosure includes a third embodiment for illustrating the design of the head, which can be found in FIG. 11 and FIG. 12. The head 302 further includes a threaded head portion 3021 (same defined name as the previous one) and an embedded thread portion 3024 located in the threaded head portion 3021. The threaded head portion 3021 can screw relative to the embedded thread portion 3024, one end of the shank 301 insert from one side of the threaded head portion 3021, and threadedly engaged with the embedded thread portion 3024. Moreover, the end of the shank 301 inserted and threadedly engaged with the embedded thread portion 3024 will penetrate the threaded head portion 3021 and be buckled with a buckle, so that the threaded head portion 3021 and the shank 301 are not fastened.

What is claimed is:

1. An adjustment structure of fitness equipment, comprising:

a holding component, having a mounting portion, and an assembly hole through the mounting portion;

an adjusting component, assembled on the mounting portion, and the adjusting component further includes an adjusting plate, an adjusting protrusion, and a spring; wherein the adjusting plate includes an assembly groove, the adjusting protrusion is movably embedded in the assembly groove, and two ends of the spring elastically against a bottom end of the adjusting protrusion and a bottom surface of the assembly groove, respectively; wherein the spring elastically pushes the adjusting protrusion to move up and down in the assembly groove; wherein the adjusting protrusion has a perforation corresponding to the assembly hole, and the perforation has an incline portion on a hole wall surface; and a movable fastener, including a shank and a head; wherein one end of the shank is connected to the head and the other end is used to movably insert into the assembly hole and the perforation; wherein the shank includes a plurality of serrated notches on an outer surface, and each serrated notch corresponds to the incline portion; wherein when the adjusting protrusion is elastically pushed by the spring, the incline portion matches and is limited by one serrated notch.

2. The adjustment structure of fitness equipment according to claim 1, wherein the assembly groove of the adjusting plate further includes a spring notch for accommodating the spring.

3. The adjustment structure of fitness equipment according to claim 1, further including a baffle disposed on one side of the adjusting plate; wherein the baffle is attached to the adjusting plate and blocks the assembly groove; wherein the baffle has an arc-shaped notch recessed at the top, and a portion of the adjusting protrusion protrudes from the arc-shaped notch.

4. The adjustment structure of fitness equipment according to claim 3, wherein the shank includes a limiting groove on the outer surface opposite to the serrated notch; wherein each of a plurality of weight plates has an engaging slot recessed from one end toward the center, and a limiting fin at the center of the engaging slot, so that the limiting fin matches and engages with the limiting groove.

5. The adjustment structure of fitness equipment according to claim 1, wherein the holding component further includes a holding bar in a cylindrical shape; wherein the holding bar has two ends for engaging with the mounting portions, and the holding bar passes through the assembly hole; wherein the number of the adjusting component is the same as the number of the mounting portion, and the movable handle is the same as the number of the mounting portion.

6. The adjustment structure of fitness equipment according to claim 4, wherein the holding component further includes a holding bar and a connecting piece, the holding bar is in a U-shape and connected with the connecting piece by two ends; wherein the assembly hole is disposed on the connecting piece, and the adjusting plate is disposed between the connecting piece and the baffle, and the assembly groove is covered.

7. The adjustment structure of fitness equipment according to claim 6, wherein each of the weight plate and the connecting piece includes a plurality of positioning convex parts and a plurality of positioning concave parts, so that the weight plate is engaged with the connecting piece or other weight plates by matching the plurality of positioning convex parts and the plurality of positioning concave parts.

8. The adjustment structure of fitness equipment according to claim 1, wherein the serrated notch of the shank tapers from the open to the end; wherein the serrated notch includes a flat surface and an inclined surface, and the incline portion of the perforation includes a flat tooth surface and an inclined tooth surface; wherein the incline portion of the adjusting protrusion fittingly engaged with inserts at the tip the serrated notch, and the flat tooth surface of the incline portion abuts the flat surface of the serrated notch, and the inclined tooth surface of the incline portion abuts the inclined surface of the serrated notch.

9. The adjustment structure of fitness equipment according to claim 4, wherein the head further includes a threaded head portion and a threaded nut portion, one end of the shank is connected to one side of the threaded head portion; wherein the threaded head portion has an outer thread on the outer periphery, and the threaded nut portion is threadedly engaged with the threaded head portion through the outer thread; wherein the threaded nut portion is screwed to press against the weight plate when the movable fastener moves the head to close to the weight plate, so that the weight plates fit closely to each other.

10. The adjustment structure of fitness equipment according to claim 1, wherein the head further includes a threaded head portion and an embedded thread portion located in the threaded head portion; wherein one end of the shank is inserted from one side of the threaded head portion and threadedly engaged with the embedded thread portion.

* * * * *